United States Patent [19]

Ueda et al.

[11] Patent Number: 4,656,787

[45] Date of Patent: Apr. 14, 1987

[54] CURVED SURFACE FORMATION POLISHING APPARATUS

[75] Inventors: Shuji Ueda, Neyagawa; Kunio Nakada, Suita; Kazuhiko Fujino, Hirakata; Hiroshi Saeki, Neyagawa; Kenji Fujishiro, Hirakata, all of Japan

[73] Assignee: Matsushita Electric Industrial Co., Ltd., Kadoma, Japan

[21] Appl. No.: 725,651

[22] Filed: Apr. 22, 1985

[30] Foreign Application Priority Data

Apr. 20, 1984 [JP] Japan ..... 59-80440

[51] Int. Cl.[4] ..... B24B 13/00

[52] U.S. Cl. ..... 51/50 R; 51/165.72; 51/105 LG

[58] Field of Search ..... 51/50 R, 50 H, 50 PC, 51/33 W, 165.72, 284 R, 284 E, 165.71, 165.8, 105 LG, 106 LG, 81 R

[56] References Cited

U.S. PATENT DOCUMENTS

| | | | |
|---|---|---|---|
| 2,431,671 | 12/1947 | Arms | 51/50 PC |
| 3,037,330 | 6/1962 | Weigand | 51/50 R |
| 3,736,818 | 6/1973 | Ennis | 51/165.72 |

FOREIGN PATENT DOCUMENTS

| | | | |
|---|---|---|---|
| 2700713 | 7/1978 | Fed. Rep. of Germany | 51/165.72 |
| 0528181 | 10/1976 | U.S.S.R. | 51/284 |

*Primary Examiner*—Frederick R. Schmidt
*Assistant Examiner*—Robert A. Rose
*Attorney, Agent, or Firm*—Wenderoth, Lind & Ponack

[57] ABSTRACT

A curved surface formation polishing apparatus for rotationally symmetrical objects such as optical lenses, mirrors, etc., which is so arranged that, by relatively displacing a processing tool and a workpiece in a direction generally intersecting at right angles with the rotary axis of the processing tool mounted on a rotating spindle so as to follow a predetermined curved surface cross section shape, grinding loci at a processing point of the workpiece formed by an abrasive grain cutting edge of the processing tool will overlap each other by crossing as the processing proceeds, thus achieving a favorable finished surface. Moreover, according to another embodiment of the present invention, more than two processing tools can be mounted on the same rotary axis, and there is provided a device for displacing the processing tools in the direction of the rotary axis so as to change-over the processing tools according to end uses and processing steps, so that change-over of the processing tools is facilitated, while it becomes possible to reduce deterioration in the accuracy of the processed shape by setting errors of the processing tools, with a simultaneous simplification of construction of the apparatus and reduction in cost for an improved mass-productivity.

13 Claims, 17 Drawing Figures

Fig. 9(A)
Fig. 9(B)
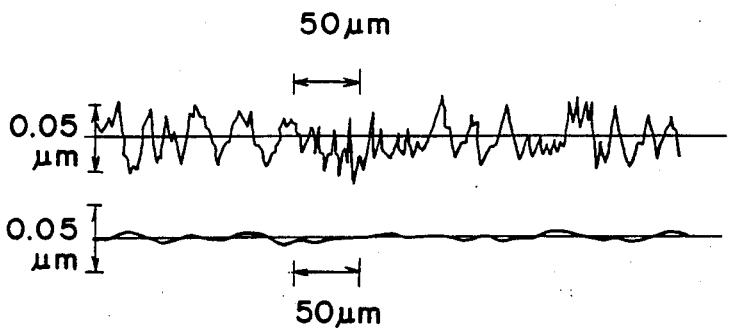
Fig. 10(A)
Fig. 10(B)
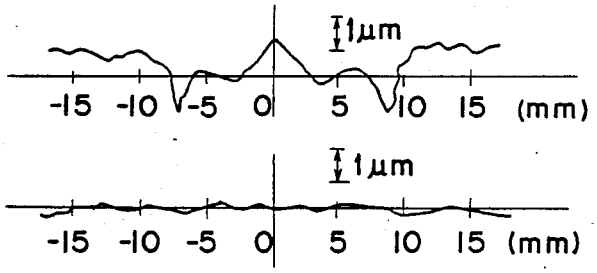

CURVED SURFACE FORMATION POLISHING APPARATUS

BACKGROUND OF THE INVENTION

The present invention generally relates to a grinding apparatus and more particularly, to a curved surface formation polishing apparatus for processing rotationally symmetrical objects such as optical lenses or mirrors, etc.

Commonly, in spherical lenses widely employed for optical systems, it is difficult to perfectly eliminate aberrations, and therefore, there has been an increasing demand for aspherical glass lenses capable of removing aberrations as performance of products is improved, with a tendency towards compact size and high density thereof. However, aspherical glass lenses have a problem that the mass production thereof is difficult, since they require a high degree of processing technique, and therefore it has been an essential object to establish a processing technique suitable for mass production at low cost.

In the conventional curved surface formation polishing apparatuses for rotationally symmetrical objects, particularly, in the aspherical lens formation grinding apparatuses, various attempts have been made as disclosed, for example, on pages 22-6 to 22-10, chapter 22 of "Trikepsue Ultra Precision Measuring Technique". One representative example of such aspherical lens formation grinding apparatus is described, for example, on pages 1717 to 1720, No. 7, VOL. 12 of "APPLIED OPTICS", and works on a processing principle as explained hereinbelow with reference to FIGS. 1(A) and 1(B) schematically illustrating construction of the known curved surface formation grinding apparatus in a top plan view (FIG. 1(A)) and a side elevational view thereof (FIG. 1(B)).

In FIGS. 1(A) and 1(B), the conventional aspherical lens formation grinding apparatus includes a rotary spindle 2 on which a processing tool 1 is mounted, a slide table 3 on which the rotary spindle is disposed so as to be controlled for displacement in directions indicated by arrows A, a workpiece rotating spindle 5 for rotatably supporting a workpiece 4, and a rotary table 6 on which said workpiece rotating spindle 5 is mounted so as to be pivotable in a direction shown by arrows B about a rotary shaft 7 of said rotary table 6. The forward edge of the processing tool 1 is rounded to have a predetermined radius of curvature as shown.

By the above arrangement, the prior art aspherical lens formation grinding apparatus functions in such a manner that, for creation of a predetermined aspherical cross sectional shape by polar coordinates, the position of the forward edge of the processing tool 1 with respect to the pivotal angle of the rotary table 6 or of the workpiece 4, i.e. the position thereof in the direction A is controlled, and thus, the grinding for the formation is effected by following the aspherical cross sectional shape in the radial direction of the workpiece 4.

In the known construction as described so far, however, since the direction of movement of the workpiece 4 by the rotation at the processing point is coincident with the grinding direction through rotation of the processing tool 1, processing loci of the abrasive grain cutting edge of said processing tool are formed in a spiral shape about a rotating center of the workpiece as the processing proceeds, with almost no crossing of each other, so that such spiral processing loci remain even after completion of the processing, thus resulting in deterioration in the quality of the processed surface, with a resultant surface roughness, for example, on the order of Rmax 0.05 micrometer to Rmax 0.2 micrometer.

Moreover, since it is difficult to impart a radius of curvature of high accuracy to the forward edge portion of the processing tool 1, while the control mechanism becomes complicated on the whole, owing to the requirement for the slide mechanism for the setting of the amount of processing, with control elements further required therefor, the allowance for the formed aspherical shape becomes $\pm 1$ micrometer or thereabout, and thus, it is difficult to achieve and maintain a sufficient accuracy in the configuration.

Furthermore, in the conventional arrangement as described above, for effecting finishing from the raw material, processing including more than two steps is required, and since the finishing is carried out by exchanging the processing tools, setting errors in the mounting of such processing tools take place, thus making it difficult to achieve a high processing accuracy.

SUMMARY OF THE INVENTION

Accordingly, an essential object of the present invention is to provide an improved curved surface formation polishing apparatus for rotationally symmetrical objects such as optical lenses, mirrors, etc., which is capable of forming a favorable finished surface by arranging in such a manner that grinding loci at a processing point of a workpiece formed by an abrasive grain cutting edge overlap each other through crossing therebetween as the processing proceeds.

Another important object of the present invention is to provide a curved surface formation polishing apparatus of the above described type, which is capable of suppressing deterioration of accuracy in the processing configuration due to setting errors for the processing tools, by facilitating change-over of processing tools according to end uses or processing steps.

In accomplishing these and other objects, according to one preferred embodiment of the present invention, there is provided a curved surface formation polishing apparatus which includes means for rotating a workpiece to be processed, a processing tool rotating means having a rotary axis generally intersecting at right angles with a rotary shaft of the workpiece, a processing tool to be mounted on the processing tool rotating means so as to be rotated thereby, means for displaying relative to each other at least either the processing tool or the workpiece in a direction of the rotary axis of the workpiece, means for varying positions of the processing tool in the direction of the rotary axis of the processing tool, and means for relatively displacing the workpiece rotating means with respect to the processing tool, in a direction generally intersecting at right angles with the rotary axis of the processing tool and the rotary axis of the workpiece.

In another aspect of the present invention, the curved surface formation polishing apparatus includes a workpiece rotating spindle, a processing tool rotating spindle having a rotary axis generally intersecting at right angles with the rotary axis of said workpiece rotating spindle, a processing tool to be mounted on the processing tool rotating spindle so as to be rotated thereby, means for displacing the processing tool in the direction of the rotary axis of the workpiece rotating spindle, means for varying positions of the processing tool in the direction of the rotary axis of the processing tool so as to be fixed, means for relatively displacing the workpiece rotating spindle with respect to said processing tool, in a direction generally intersecting at right angles with the rotary axis of the processing tool and the rotary axis of the workpiece rotating spindle, a length measuring system for detecting relative displacement of the processing tool and the workpiece rotating spindle, and an NC control device for controlling the relative displacement of the processing tool and the workpiece rotating spindle.

In a further aspect of the present invention, the curved surface formation polishing apparatus includes a workpiece rotating spindle, a processing tool rotating spindle having a rotary axis generally intersecting at right angles with the rotary axis of the workpiece rotating spindle, two or more processing tools coaxially mounted on the processing tool rotating spindle so as to be rotated thereby, means for relatively displacing the workpiece rotating spindle with respect to the processing tool in the direction of the rotary axis of the workpiece rotating spindle, means for relatively displacing the workpiece rotating spindle with respect to the processing tool in a direction generally intersecting at right angles with the rotary axis of the processing tools and the rotary axis of the workpiece rotating spindle, and means for displacing the processing tools in the direction of the rotary axis of said processing tools.

In still another aspect of the present invention, the curved surface formation polishing apparatus is constituted by a workpiece rotating spindle, a processing tool rotating spindle having a rotary axis generally intersecting at right angles with the rotary axis of the workpiece rotating spindle, two or more processing tools coaxially mounted on the processing tool rotating spindle so as to be rotated thereby, means for relatively displacing the workpiece rotating spindle with respect to the processing tools in the direction of the rotary axis of the workpiece rotating spindle, means for relatively displacing the workpiece rotating spindle with respect to the processing tools in a direction generally intersecting at right angles with the rotary axis of the processing tools and the rotary axis of the workpiece rotating spindle, means for displacing the processing tools in the direction of the rotary axis of said processing tools for fixing, a length measuring system for detecting relative displacement of the processing tools and the workpiece rotating spindle, and an NC control device for controlling the relative displacement of the processing tools and the workpiece rotating spindle.

By the arrangement according to the present invention as described above, since the curved surface configuration is created by moving the rotating processing tool relatively with respect to the workpiece, in a direction intersecting generally at right angles with the rotary axis of the processing tool, under the common conditions for the fine grinding in which the abrasive grain cutting edge acts in a region under a critical breaking stress of the workpiece material, the grinding loci formed on the surface of the workpiece by the abrasive grain cutting edge of the processing tool are crossed at respective processing points to overlap each other as the processing proceeds, and therefore, the undesirable remaining spiral grinding loci as in the conventional arrangements can be eliminated to achieve an extremely favorable finished surface. Moreover, owing to the fact that the cutting edge configuration of the tool for the processing is generally determined by the rotational radius of the processing tool, processing can be effected by fewer control elements, without being affected by the shape at the forward edge of the processing tool.

Furthermore, according to the present invention, since it is so arranged that the plurality of processing tools different in end uses and grain particle diameters are incorporated in the same rotating spindle for change-over through sliding in the direction of the rotary axis according to the end uses and processing steps, it becomes unnecessary to exchange processing tools, for example, at a time point for shifting from the rough grinding to the fine grinding, and thus, deterioration of the accuracy in the processed shape due to setting errors can be reduced.

BRIEF DESCRIPTION OF THE DRAWINGS

These and other objects and features of the present invention will become apparent from the following description of the preferred embodiments thereof taken in conjunction with the accompanying drawings, in which:

FIG. 9(A) is a diagram showing finished surface roughness data obtained by the conventional arrangement;

FIG. 9(B) is a diagram similar to FIG. 9(A), which particularly shows finished surface roughness data obtained by the apparatus according to the first embodiment of the present invention;

FIG. 10(A) is a diagram showing aspherical surface error data obtained by the conventional arrangement;

FIG. 10(B) ia a diagram similar to FIG. 10(A) which particularly shows aspherical surface error data obtained by the apparatus according to the first embodiment of the present invention;

DETAILED DESCRIPTION OF THE INVENTION

Figure 1A:
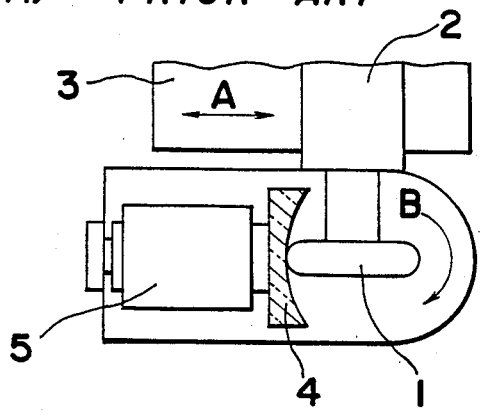
Fig. 1(A) PRIOR ART
FIG. 1(A) is a top plan view of a main portion of a conventional aspherical surface formation grinding apparatus for explaining the general concept of functioning thereof (already referred to)

Before the description of the present invention proceeds, it is to be noted that like parts are designated by like reference numerals throughout the accompanying drawings.

Figure 2A:
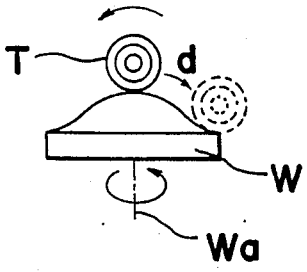
FIG. 2(A) is a schematic front elevational view of a main portion of a curved surface formation polishing apparatus according to a first embodiment of the present invention for explaining the general concept of functioning thereof.
Figure 2B:
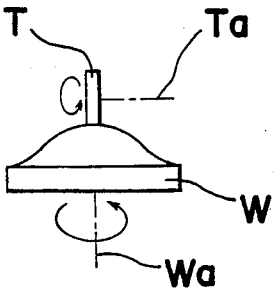
FIG. 2(B) is a schematic side elevational view of a portion of FIG. 2(A)

Referring now to the drawings, a curved surface formation polishing apparatus according to a first embodiment of the present invention will be described hereinbelow. In FIGS. 2(A) and 2(B), there is shown an essential portion of the curved surface formation polishing apparatus for explaining the general concept of the functioning thereof, in which a processing tool T mounted on a rotating spindle for rotation at high speeds is arranged to be moved in the radial direction of the workpiece W i.e. in the direction d intersecting approximately at right angles with the rotary axis Ta of the processing tool T, while the workpiece W is adapted to rotate about its rotary axis Wa so as to obtain a rotationally symmetrical curved surface.

Figure 3:
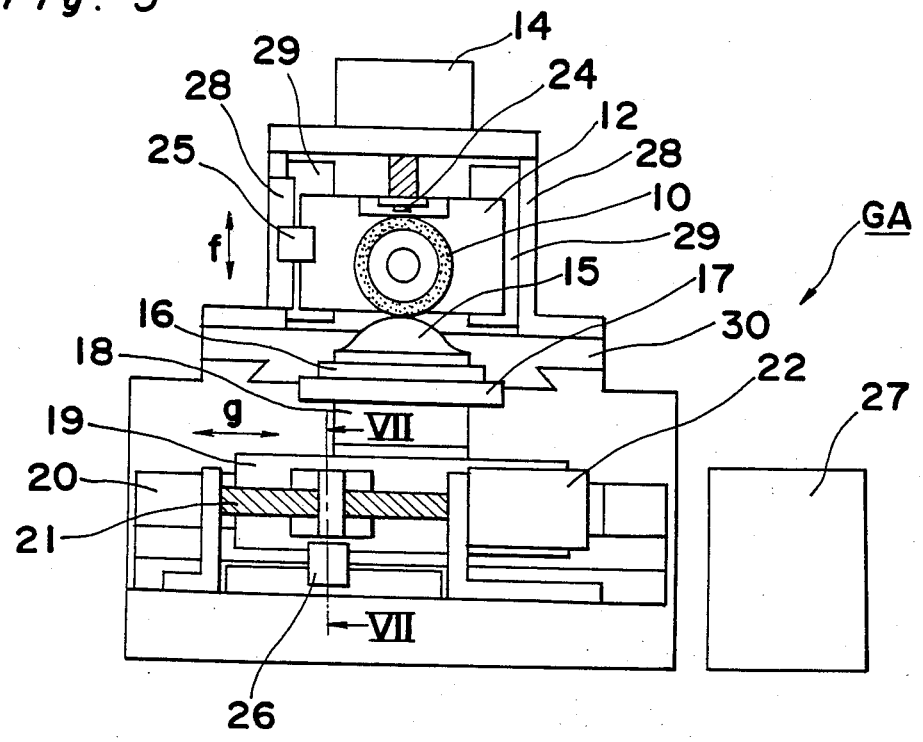
FIGS. 3 and 4 are respectively front and side elevational views of the curved surface formation polishing apparatus according to a first embodiment of the present invention.
Figure 4:
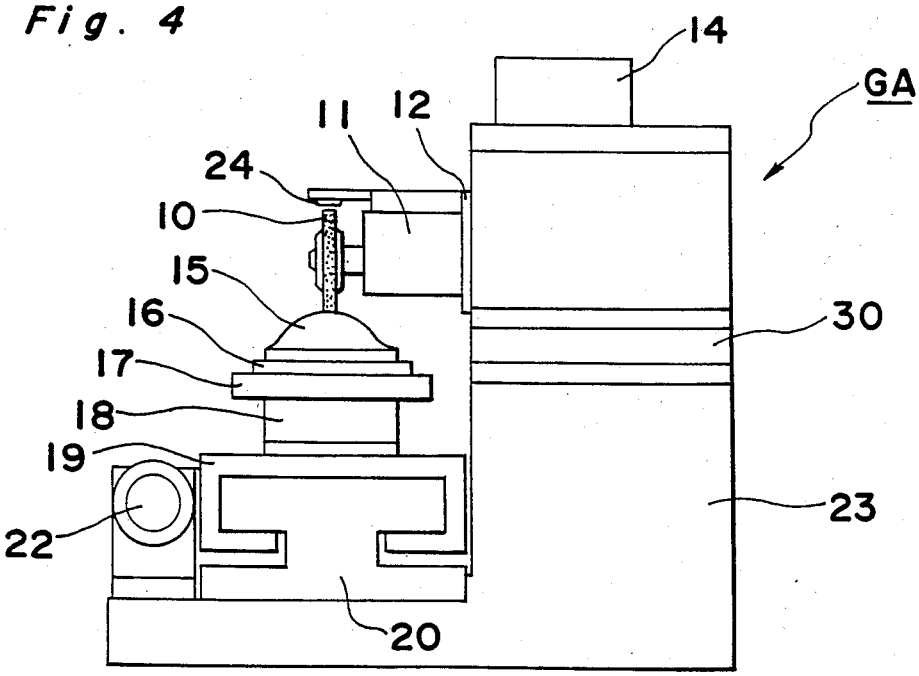

Referring also to FIGS. 3 and 4, there is schematically shown the curved surface formation polishing apparatus GA according to a first embodiment of the present invention. The polishing apparatus GA includes a rotating spindle 11 having a high accuracy bearing such as a static pressure pneumatic bearing, etc., a processing tool 10, for example, a diamond grinding wheel or the like mounted on said rotating spindle 11 so as to be rotated at high speeds in the range of 20,000 to 150,000 r.p.m., a spindle holder portion 12 which holds the rotating spindle 11 for movement in a vertical direction (i.e. in a direction f in FIG. 3) by a driving screw 13 such as bolt screw, static pressure screw or the like and a driving unit (not shown) in a driving section housing 14, a processing tool driving section housing 28, a roller bearing guide block 29 for enabling the spindle holder portion 12 to slide in the direction f, a slide table 30 for sliding the processing tool driving section housing 28 in the direction of the rotary axis of the processing tool 10, a rotary table 17 on which a workpiece 15, for example, of optical glass or the like is fixed by a vacuum or collet chuck 16, a workpiece rotating spindle 18 employing a static pressure pneumatic bearing, and utilized as a rotating means for forming the workpiece 15 to have a rotationally symmetrical curved surface, a slide table 19 having a high accuracy bearing such as a static pressure pneumatic bearing, etc. and adapted to have said workpiece rotating spindle 18 mounted thereon so as to move it in directions intersecting generally at right angles with respect to the rotary axis of the processing tool 10 and also with respect to the rotary axis of the workpiece 15, i.e., in directions indicated by arrows g in FIG. 3, a static pressure pneumatic bearing guide bar 20, a driving screw 21 such as a bolt screw, static pressure screw, etc. for driving the slide table 19 and adapted to be driven by a DC servo-motor 22, an apparatus main base 23, and a fine displacement sensor 24 of a static capacity type, eddy current type or the like for detecting the rotational radius of the processing tool 10, and mounted on the rotating spindle 11. There are further provided corner cubes 25 and 26 as displacement detecting sensors such as laser interference length measuring units, etc., respectively in the direction of movement f of the spindle holder portion 12, and in the direction of movement g of the slide table 19, as displacement detecting sensors, for example, of laser interference length measuring units, etc. and thus, the functionings of the spindle holder portion 12 and of the slide table 19 are controlled in a closed loop with a very high accuracy with a resolving power of 0.02 micrometer by data from the displacement detecting sensors 25 and 26. It is to be noted here that the curved surface formation polishing apparatus GA as described so far is arranged to be controlled by a control unit 27, including said closed loop function control.

Figure 5:
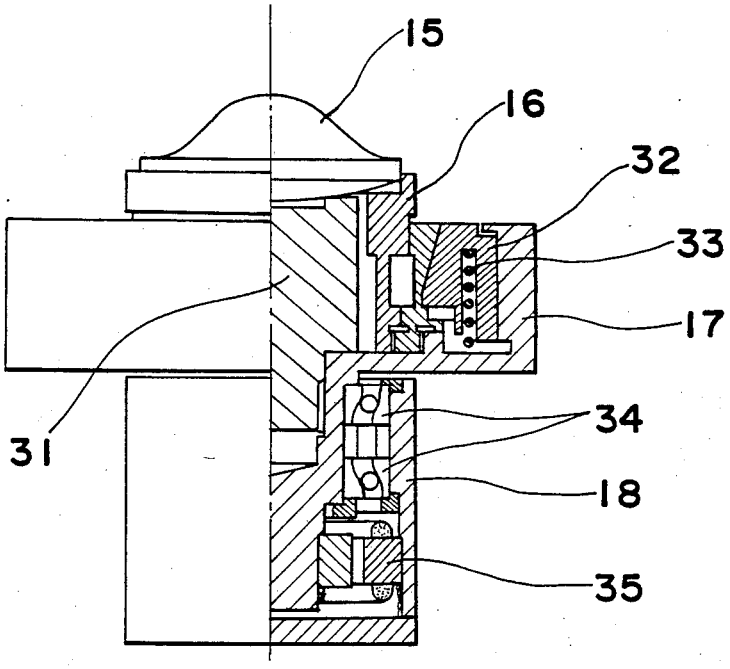
FIG. 5 is a side elevational view showing on an enlarge scale and partly in section, a workpiece rotating spindle as applied to the first embodiment of FIGS. 3 and 4.

In FIG. 5, there is shown, on an enlarged scale and partly in section, a side elevational view illustrating a specific construction of the workpiece rotating means sectioned at a plane including the rotary axis of the workpiece 15 and applied to the first embodiment of the present invention. The workpiece rotating means includes a workpiece position restricting jig 31 for proper positioning of the workpiece 15, a spacer 32 and a spring 33 provided between the chuck 16 and the rotary table 17 for actuating said chuck 16, a radial ball bearing 34, and a driving motor 35 provided within the spindle 18.

Figure 6:
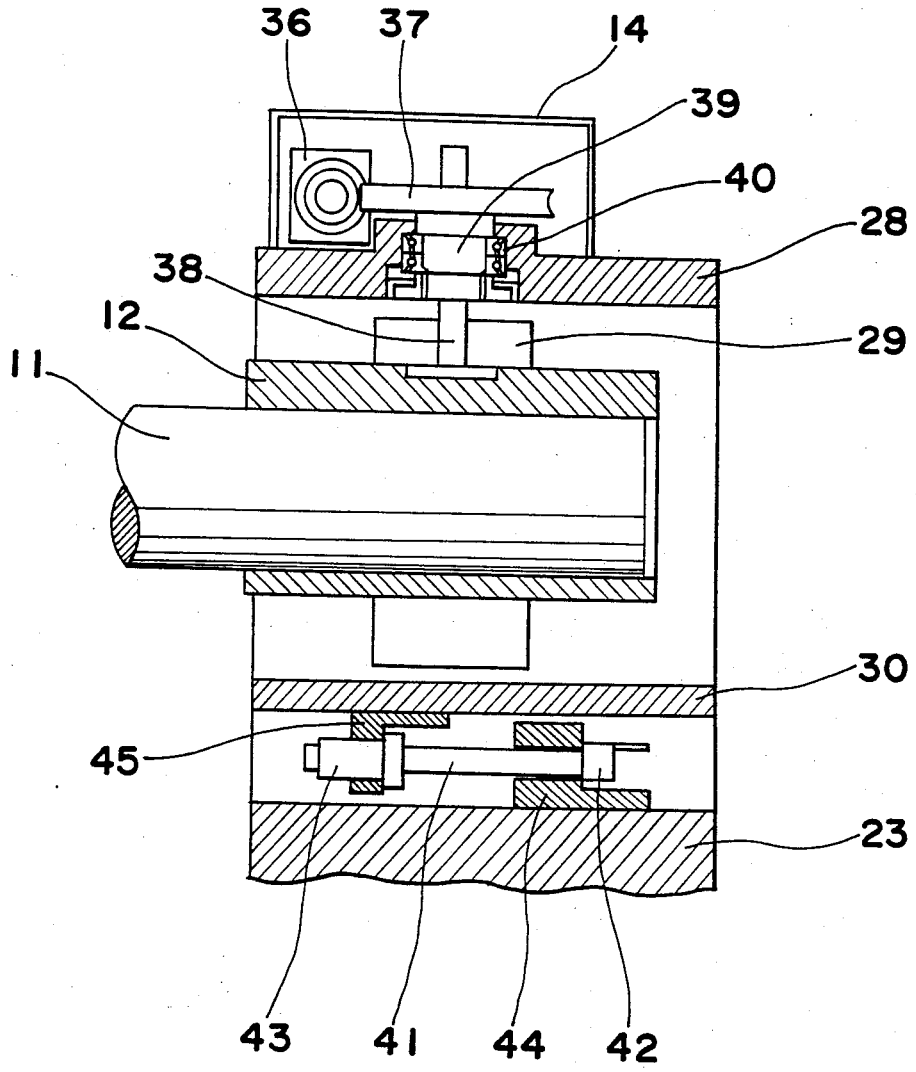
FIG. 6 is a side sectional view showing on an enlarged scale, a processing tool rotating spindle and its driving portion as applied to the first embodiment of FIGS. 3 and 4.

FIG. 6 is a side sectional view showing on an enlarged scale, a processing tool rotating spindle and its driving portion as applied to the first embodiment of the present invention for explaining the driving portion for the processing tool in the directions of the arrows f and position adjusting means in the direction of the workpiece rotating spindle.

In FIG. 6, within a driving section housing 14, there are provided a driving motor 36 connected at its output shaft to a worm gear 37, a driving screw 38 coupled with the shaft for the worm gear 37 and rotatably journalled in a radial ball bearing 40 provided around a nut 39 so as to be connected at its end with the spindle holder portion 12 for the rotating spindle 11. In the slide table 30, a driving screw 41 is supported at its head portion or handle 42 by a bracket 44 fixed to the main body base 23, and at its other end is threaded into a nut 43 held by another bracket 45 secured to the slide table 30, and thus, by turning the screw handle 42, it is possible to displace the processing tool 10 in the direction of its rotary axis for adjustment of the position thereof. After adjusting the position of the processing tool 10, said tool 10 can be fixed in its position in the direction of the rotary axis thereof by stopping the relative displacement between the slide table 30 and the main body base 23 by a fixing screw or the like (not shown).

Figure 7:
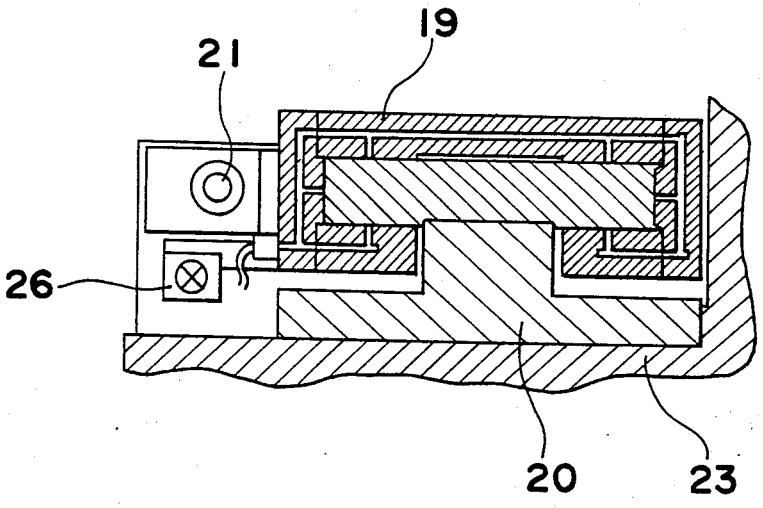
FIG. 7 is a cross section on an enlarged scale, taken along the line VII—VII in FIG. 3.

FIG. 7 is a cross section on an enlarged scale, taken along the line VII—VII in FIG. 3, and specifically showing construction of the driving means for the slide table 19, with like parts in FIG. 3 being designated by like reference numerals.

Figure 8:
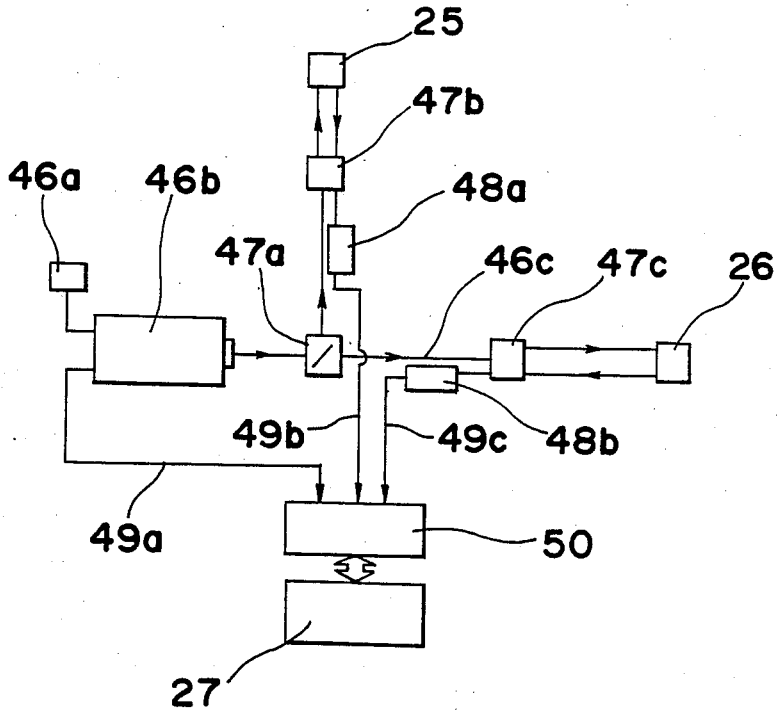
FIG. 8 is the block diagram showing a general construction of a length measuring system as applied to the present invention.

Referring further to FIG. 8, there is shown a block diagram of a laser length measuring system as applied to the embodiment according to the present invention. In FIG. 8, the system includes an HeNe laser light source **46*b* connected to a power source 46*a*, a beam splitter 47*a* for splitting a laser beam 46*c* for directing into interferometers 47*b* and 47*c*, and detectors 48*a* and 48*b*, with a reference signal 49*a* and measuring signals 49*b* and 49*c* being led into a pulse output unit 50 coupled to a control unit 27, from the light source 46***b*, and detectors 48*a* and 48*b*.

The functioning of the curved surface formation polishing apparatus having the construction as described so far will be explained hereinbelow.

In the first place, for creating the predetermined curved surface, the radius of rotation of the processing tool 10 rotating at high speeds is measured by the fine displacement sensor 24, and based on data thus obtained, function control data are calculated by a computer according to programs preliminarily stored so as to drive the processing tool 10 and the workpiece 15 respectively in the directions indicated by the arrows f and g (FIG. 3) for grinding the workpiece 15 into the predetermined curved surface configuration. Then, the workpiece 15 is secured to the rotary table 17 by the vacuum chuck 16. Upon starting of the processing after setting the processing conditions such as speed of rotation of the workpiece 15, depth of cut by the processing tool 10, curved surface forming speed, etc., the processing tool 10 and the workpiece 15 function so as to finish the workpiece 15 to give it the predetermined curved surface configuration, based on the preliminarily calculated function control data referred to above. In the above case, for the respective amounts of the functioning, the data of the displacement detecting sensors 25 and 26 are fed back for the closed loop control. Moreover, the workpiece 15 is rotated by the workpiece rotating spindle 18 at the predetermined speed of rotation so as to be formed to have the rotationally symmetrical curved surface.

Since the radius of rotation of the processing tool 10 rotating at high speeds varies due to abrasion of the processing tool 10 and this variation results in errors in the curved surface configuration to be created, periodical measurements are effected by the fine displacement sensor 24 for correction of the function control data.

Accordingly, owing to the fact that the processing tool 10 may be moved in a direction approximately intersecting at right angles with the rotary axis of said processing tool 10, relatively with respect to the workpiece 15, grinding loci at the processing point of the workpiece formed by the abrasive grain cutting edge of the processing tool 10 overlap each other by crossing each other as the processing proceeds, thus achieving a favorable finished surface with a surface roughness below Rmax 0.01 micrometer.

Meanwhile, since the processing tool cutting edge configuration for the curved surface forming processing is determined by the radius of rotation of the processing tool 10 so as to achieve high accuracy, a formed curved surface configuration accuracy below 0.3 micrometer can be realized.

For representing the effects available from the curved surface formation polishing apparatus according to the first embodiment of the present invention, FIG. 9(A) shows a diagram for finished surface roughness data obtained by a conventional polishing apparatus, while FIG. 9(B) is a diagram similar to FIG. 9(A), which particularly gives finished surface roughness data as obtained by the polishing apparatus of the present invention. On the other hand, FIG. 10(A) shows a diagram for aspherical surface error data in the conventional polishing apparatus, while FIG. 10(B) is a diagram similar to FIG. 10(A), which particularly shows aspherical surface error data obtained by the polishing apparatus of the present invention. In both of the above comparative diagrams, the data in FIG. 9(B) and FIG. 10(B) for the present invention show marked improvement over the data in FIG. 9(A) and FIG. 10(A) for the conventional arrangement.

Figure 1B:
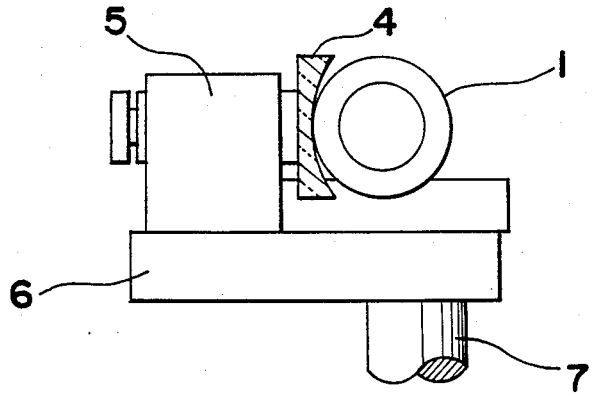
Fig. 1(B) PRIOR ART
FIG. 1(B) is a side elevational view of the portion in FIG. 1(A) (already referred to)

It should be noted here that in the foregoing embodiment, although it is so arranged that the aspherical cross sectional shape is followed by the rectangular coordinates, the present invention may be applied to a curved surface formation apparatus adapted to follow the configuration by the polar coordinates as in the conventional arrangement of FIG. 1.

It is also to be noted that, in the foregoing embodiment, the rotary axis of the processing tool 10 is disposed so as to generally intersect at right angles with respect to the radial direction at the processing point of the workpiece 15, but the arrangement may be so modified, for example, that the rotary axis of the processing tool 10 is disposed at a predetermined angle instead of being disposed at the general right angles as above, and in this case, predetermined processing configuration accuracy may be maintained by effecting a correcting calculation for the configuration error due to displacement of the processing point of the processing tool 10.

It should further be noted that, in the foregoing embodiment, although the processing tool 10 has been described as a diamond grinding wheel, such processing tool 10 may be in the form of a multi-blade wheel having a single blade or several cutting tools to form the curved surface by cutting processing.

As is seen from the foregoing description, in the curved surface formation polishing apparatus according to the present invention, the rotary axis of the processing tool is disposed at a predetermined angle with respect to the radial direction at the processing point of the workpiece, and by displacing the workpiece or processing tool so as to follow the curved surface cross sectional shape in the radial direction at the processing point of the workpiece, the grinding loci formed on the surface of the workpiece by the abrasive grain cutting edge of the processing tool overlap each other by crossing at the respective processing points as the processing proceeds, thus providing an extremely favorable finished surface. Moreover, by disposing the rotary axis of the processing tool so as to intersect generally at right angles with respect to the radial direction at the processing point of the workpiece, i.e., by making the predetermined angle referred to earlier approximately a right angle, the configuration of the processing tool cutting edge during the curved surface forming processing is determined by the radius of rotation of the processing tool, and therefore, formation of the radius of curvature or rounding at the cutting edge at high accuracy as required in the conventional arrangement is not required, while the error in the configuration due to displacement of the processing point of the processing tool may also be eliminated to provide a formed curved surface configuration having higher accuracy with fewer control elements.

Figure 11A:
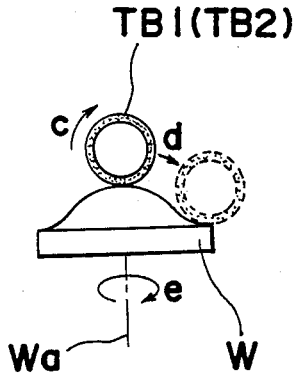
FIG. 11(A) is a schematic front elevational view of a main portion of a curved surface formation polishing apparatus according to a second embodiment of the present invention for explaining the general concept of functioning thereof.
Figure 11B:
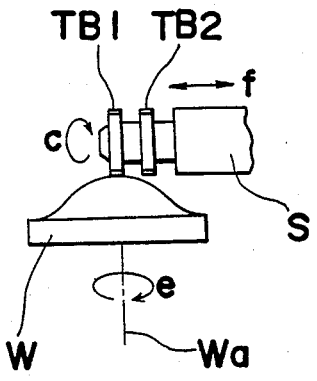
FIG. 11(B) is a schematic side elevational view of a portion of FIG. 11(A)
Figure 12:
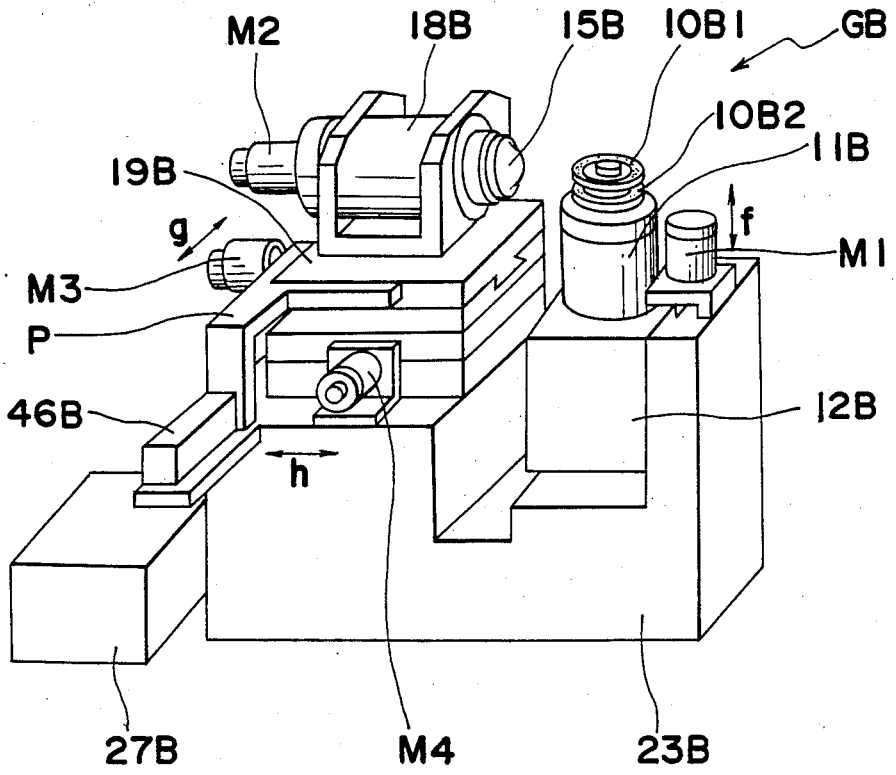
FIG. 12 is a perspective view of the curved surface formation polishing apparatus according to a second embodiment of the present invention.

Referring now to FIGS. 11(A) to 12, a curved surface formation polishing apparatus according to a second embodiment of the present invention will be described hereinbelow. In FIGS. 11(A) and 11(B), there is shown an essential portion of the curved surface formation polishing apparatus GB for explaining the general concept of the functioning thereof, in which a first processing tool TB1 for rough grinding and a second processing tool TB2 for fine grinding mounted on a rotating spindle S are arranged to be rotated in the radial direction of the workpiece W or in the direction indicated by the arrow C. The processing tools TB1 and TB2 or the workpiece W are relatively moved in the radial direction of the workpiece W, i.e., in a direction d intersecting at right angles with the rotary axis for said processing tools TB1 and TB2, while the workpiece W is rotated in the direction indicated by the arrow e about the axis Wa so as to obtain a rotationally symmetrical curved surface. For the actual processing, the rough grinding processing tool TB1 and the fine grinding processing tool TB2 are displaced in the directions f at a proper time to achieve the desired result.

Referring also to FIG. 12, there is illustrated the curved surface formation polishing apparatus GB according to the second embodiment of the present invention. The polishing apparatus GB includes a rotating spindle 11B having a high accuracy bearing such as a static pressure pneumatic bearing, etc., a rough grinding processing tool 10B1 and a fine grinding processing tool 10B2, for example, of diamond grinding wheels or the like mounted on said rotating spindle 11B so as to be rotated at high speeds in the range of 30,000 to 100,000 rpm, a spindle holder portion 12B which holds the rotating spindle 11B for functioning in a vertical direction (i.e., in directions f in FIG. 12) by a driving screw (not shown) such as a bolt screw, static pressure screw or the like and a driving motor M1 so as to change over the processing tools 10B1 and 10B2, a workpiece rotating spindle 18B on which the workpiece 15B, for example, of optical glass, etc. is fixed and which employs a static pressure pneumatic bearing at high accuracy so as to be controlled for rotational speeds in the range of 0.2 to 200 rpm by a driving motor M2, a highly accurate slide table 19B with two axes intersecting at right angles, and arranged to mount the workpiece rotating spindle 18B thereon for moving it so as to draw a predetermined aspherical surface cross sectional shape at the contact point of the processing tool 10B1 or 10B2 in planes intersecting at right angles to each other, with respect to the rotary axis for the rough grinding processing tool 10B1 and fine grinding processing tool 10B2, DC servomotors M3 and M4 for driving the respective two axes intersecting at right angles, a laser length measuring system for effecting the NC closed loop control through detection of the displacing amounts of the above two axes in the functioning directions g and h, and including a laser light source 46B and an interferometer optical system P generally similar to that in the embodiment of FIG. 8, and an apparatus main body base 23B. The curved surface formation polishing apparatus GB as described above is controlled by a control unit 27B, including the closed loop function control.

Hereinbelow, functioning of the curved surface formation polishing apparatus GB having the construction as described so far will be explained.

Firstly, for creating the predetermined curved surface, based on the radii of rotation of the processing tools 10B1 and 10B2 rotating at high speeds, function control data are calculated by a computer according to programs preliminarily stored so as to drive the workpiece 15B in the directions indicated by the arrows g and h for grinding the workpiece 15B into the predetermined curved surface configuration. Then, the workpiece 15B is secured to the workpiece rotating spindle 18B. Upon starting of the processing after setting the processing conditions such as speed of rotation of the workpiece 15B, depth of cut by the processing tools 10B1 and 10B2, curved surface forming speed, amount of displacement of the processing tool rotating spindle 11B in the direction f for the change-over between the processing tools 10B1 and 10B2, etc., the processing tool 10B1 and the workpiece 15B function so as to finish said workpiece 15B to have the predetermined curved surface configuration, based on the preliminarily calculated function control data referred to above. In the above case, for the function of the highly accurate slide table 19B with the two axes intersecting at right angles, the data in the directions g and h from the laser length measuring system including the laser light source 46B and the interference optical system P are fed back for the closed loop control. Thereafter, for shifting to the fine grinding, the processing tool rotating spindle 11B is displaced a predetermined amount in the direction f by the driving motor M1 to index the position at which the fine grinding processing tool 10B2 is usable for the processing, and under this state, the processing tool 10B2 and the workpiece 15B function for effecting the fine grinding.

As is seen from the above description, according to the second embodiment of the present invention, the control elements are simplified, and a formed curved surface configuration accuracy of 0.1 micrometer and surface roughness at Ra 0.004 micrometer can be achieved, and thus, an aspherical glass lens of about 50 mm in diameter or so can be processed in a tact time of about 4 minutes.

It is to be noted here that in the above embodiment, although the arrangement is such that the aspherical cross sectional shape is followed by the rectangular coordinates, the present invention may be applied to a curved surface formation apparatus employing a displacing means including a rotary axis as means for moving the workpiece or processing tool, and arranged to follow the aspherical surface configuration by polar coordinates.

It is also to be noted that in the foregoing embodiment, diamond grinding wheels are employed for the rough grinding processing tool 10B1 and the fine grinding processing tool 10B2, but other grinding wheels or multiblade wheels, etc. may be applied thereto, and moreover, it is possible to form the curved surface by cutting processing.

It should further be noted that, although the above embodiment has been mainly described with reference to the case where two processing tools are attached to the rotating spindle, the number of the processing tools is not limited to the above, but may be increased to more than three, and in this case, a plurality of diamond grinding wheels having stepwisely different particle sizes for abrasive grain cutting edges, other grinding wheels, multi-blade wheel tools, etc. can be mounted in aligned condition on the same axis, so as to exchange the tools by sliding in the axial direction according to end uses and processing steps. Furthermore, a plurality of the same processing tools may be mounted on the same axis so as to replace any one tool by another tool for efficient operation.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A curved surface formation polishing apparatus which comprises:

means for rotating a workpiece to be processed about a workpiece rotary axis;

a processing tool rotating means having a processing tool rotary axis generally intersecting at right angles with the workpiece rotary axis and being for holding a processing tool thereon so as to be rotated thereby around said processing tool rotary axis;

means for relatively displacing said processing tool rotating means and said workpiece rotating means in a direction parallel to the workpiece rotary axis;

means for varying the position of said processing tool rotating means in the direction parallel to said processing tool rotary axis; and means for displacing said workpiece rotating means relative to said processing tool rotating means in a direction generally at right angles to the processing tool rotary axis and the workpiece rotary axis.

2. A curved surface formation polishing apparatus which comprises:

a workpiece rotating spindle for carrying a workpiece and having a workpiece rotary axis, and means for rotating said spindle around said workpiece rotary axis;

a processing tool rotating spindle for carrying a processing tool and having a processing tool rotary axis, and means for rotating said processing tool rotary spindle around said processing tool rotary axis;

means for displacing said processing tool rotating spindle in a direction parallel to the workpiece rotary axis;

means for varying the position of said processing tool rotating spindle in a direction parallel to the processing tool rotary axis;

means for displacing said workpiece rotating spindle relative to said processing tool rotating spindle in a direction generally intersecting at right angles said workpiece rotary axis and said processing tool rotary axis;

a laser length measuring system including a laser light source and an interferometer optical system for detecting relative displacement of said processing tool rotating spindle and said workpiece rotating spindle; and an NC control device for controlling the relative displacement of said processing tool rotating spindle and said workpiece rotating spindle.

3. A curved surface formation polishing apparatus which comprises:

a workpiece rotating spindle for carrying a workpiece and having a workpiece rotary axis, and means for rotating said spindle around said workpiece rotary axis;

a processing tool rotating spindle having a processing tool rotary axis generally intersecting at right angles the workpiece rotary axis, and means for rotating said processing tool rotating spindle around said processing tool rotary axis;

at least two processing tools coaxially mounted on said processing tool rotating spindle for being rotated thereby;

means for relatively displacing said workpiece rotating spindle with respect to said processing tools in a direction parallel to the workpiece rotary axis;

means for relatively displacing said workpiece rotating spindle with respect to said processing tools in a direction generally intersecting at right angles with the processing tool rotary axis and the workpiece rotary axis; and means for displacing said processing tools in a direction parallel to the processing tool rotary axis.

4. A curved surface formation polishing apparatus as claimed in claim 3 wherein said processing tools include a plurality of processing tools for the same end use.

5. A curved surface formation polishing apparatus as claimed in claim 3 wherein said processing tools include a plurality of processing tools for different end uses.

6. A curved surface formation polishing apparatus as claimed in claim 3 in which said processing tools include a plurality of grinding wheels having different abrasive grain particle sizes which vary stepwise from grinding wheel to grinding wheel.

7. A curved surface formation polishing apparatus as claimed in claim 3 wherein said processing tools are a rough grinding wheel and a finish grinding wheel.

8. A curved surface formation polishing apparatus which comprises:

a workpiece rotating spindle for carrying a workpiece and having a workpiece rotary axis, and means for rotating said spindle around said workpiece rotary axis;

a processing tool rotating spindle having a processing tool rotary axis generally intersecting at right angles the workpiece rotary axis, and means for rotating said processing tool rotating spindle around said processing tool rotary axis;

at least two processing tools coaxially mounted on said processing tool rotating spindle for being rotated thereby;

means for relatively displacing said workpiece rotating spindle with respect to said processing tools in a direction parallel to the workpiece rotary axis;

means for relatively displacing said workpiece rotating spindle with respect to said processing tools in a direction generally intersecting at right angles with the processing tool rotary axis and the workpiece rotary axis;

means for displacing said processing tools in a direction parallel to the processing tool rotary axis;

a length measuring system for detecting relative displacement of said processing tools and said workpiece rotating spindle; and an NC control device for controlling the relative displacement of said processing tools and said workpiece rotating spindle.

9. A curved surface formation polishing apparatus as claimed in claim 8 wherein said processing tools include a plurality of processing tools for the same end use.

10. A curved surface formation polishing apparatus as claimed in claim 8 wherein said processing tools includes a plurality of processing tools for different end uses.

11. A curved surface formation polishing apparatus as claimed in claim 8 in which said processing tools include a plurality of grinding wheels having different abrasive grain particle sizes which vary stepwise from grinding wheel to grinding wheel.

12. A curved surface formation polishing apparatus as claimed in claim 8 wherein said processing tools are a rough grinding wheel and a finish grinding wheel.

13. A curved surface formation polishing apparatus as claimed in claim 8 wherein said length measuring system is a laser length measuring system including a laser light source and an interferometer optical system.

* * * * *